United States Patent [19]

Candor

[11] 3,937,466

[45] *Feb. 10, 1976

[54] METHOD FOR PLAYING STRATEGY GOLF

[76] Inventor: James T. Candor, 5440 Cynthia Lane, Dayton, Ohio 45429

[ * ] Notice: The portion of the term of this patent subsequent to June 28, 1991, has been disclaimed.

[22] Filed: Feb. 18, 1975

[21] Appl. No.: 550,476

Related U.S. Application Data

[63] Continuation of Ser. No. 406,643, Oct. 15, 1973, abandoned, which is a continuation of Ser. No. 220,045, Jan. 24, 1972, abandoned.

[52] U.S. Cl. ..... 273/32 R; 273/176 L; 35/29 A

[51] Int. Cl.[2] ..... A63B 57/00; A63B 69/36

[58] Field of Search ..... 273/176, 134 CG, 32, 35, 273/87.2, 87.4, 87; 35/29 A

[56] References Cited

UNITED STATES PATENTS

| | | | |
|---|---|---|---|
| 1,470,117 | 10/1923 | Mac Rae | 273/176 L |
| 3,552,290 | 1/1971 | Brechtel | 273/176 L |
| 3,589,732 | 6/1971 | Russell | 273/176 L X |
| 3,643,959 | 2/1972 | Cornell et al. | 273/176 L X |
| 3,820,786 | 6/1974 | Candor | 273/176 L X |

*Primary Examiner*—George J. Marlo

*Attorney, Agent, or Firm*—Candor, Candor & Tassone

[57] ABSTRACT

A kit for laying out in simulation form one or more holes of golf for the purpose of studying and then subsequently playing each such hole for the minimum score for the golfer's ability wherein each simulated hole is provided by a first sheet having markings thereon to designate increments of distance from a golf green disposed thereon. A golf tee area disposed on the first sheet at a preselected distance from the green and natural hazards are also disposed on the first sheet between the tee area and the golf green to simulate the hazards the golfer might encounter when playing that particular hole of golf. A smaller, transparent sheet having markings designating increments of distance from a point on the smaller sheet is disposed on the first sheet with the point of the smaller sheet at the golf tee area and with its incremental markings being directed in a desired direction toward the golf green.

5 Claims, 7 Drawing Figures

METHOD FOR PLAYING STRATEGY GOLF

This application is a continuation application of its copending parent patent application, Ser. No. 406,643, filed Oct. 15, 1973, now abandoned, which, in turn, is a continuation application of its copending parent application, Ser. No. 220,045, filed Jan. 24, 1972, now abandoned.

This invention relates to a kit for laying out one or more holes of a golf course in a simulating manner so that the golfer can not only plan in advance the playing of that particular golf course with a stroke and club plan commensurate with the golfer's ability but also to provide means for the golfer to record his round of golf for a more accurate later study thereof to enhance self improvement in the playing of golf.

It is well known from the book, *Situation Golf*, by Arnold Palmer and published by McCall Publishing Company of New York in 1970, that the author stresses the fact that before the golfer actually tees off on a particular hole of golf, he should have a full battle plan for the hole worked out in his mind in order to best score in a manner that takes in the ability of the golfer. In fact, such book sets forth nine holes of simulated golf play and how each hole should be played by a golfer with a low handicap, a medium handicap and a high handicap.

Therefore, it is a feature of this invention to provide means wherein a golfer can utilize the strategy conveyed in such book to lay out a round of golf that that player normally plays in a simulated manner and with which that player can thereafter make adjustments in his game to fit his battle plan for that particular course so as to practice the teachings set forth in the aforementioned book, *Situation Golf*.

In particular, one embodiment of this invention provides a standardized first sheet having concentric arcs disposed thereon and respectively being described from a point on the sheet to designate increments of distance from that point. The golfer can place a simulated golf green at that point to represent the golf green for a particular hole of golf that he desires to play. The golfer also disposes a golf tee area on the sheet at a preselected distance from the point thereon as well as well as disposes pieces representing natural hazards on the sheet between the tee area and the golf green so as to simulate that particular hole of golf. A smaller, transparent sheet having concentric arcs described from a point on the smaller sheet to designate increments of distance from that point is placed on the first sheet with the point of the smaller sheet on the golf tee area and with its incremental means directed in a desired "drive" or first shot direction toward the golf green. Such smaller sheet is then marked on by the golfer to designate a desired first shot area from the tee area when the golfer should place his first shot in order that succeeding shots, also laid out on the assembled sheets, will conform to the ability of that golfer in playing that particular hole to the best of his natural ability and with as little shot trouble as possible.

Such completed and assembled sheets can then be disposed as a unit into a transparent envelope or pocket means so that the simulated hole of golf can be readily viewed therethrough. Such covered sheets can then be utilized during the actual playing of the round of golf for reference purposes and/or for record keeping purposes so that when that particular hole is actually played, the golfer can mark on the outer covering sheet the various shots, ball positions and clubs utilized in playing that particular hole of golf so that the same can be later studied at his leisure for better perfecting his golf game and perhaps for changing his battle plan for that particular hole of golf. Alternately, such covered and assembled sheets can be utilized in a duplicating machine to provide a copied sheet therefrom and which can also be marked upon when the golfer plays that particular hole to record the various shots taken, etc. for later study and later permanent record-keeping purposes. For example, by keeping such a permanent record of each round of golf played for a year will indicate the best possible battle plan of that golfer for the following year, etc.

Therefore, it is an object of this invention to provide means for simulating a hole of golf that a golfer will actually play in a manner that the golfer can pre-plan his strategy for playing such hole of golf.

Other objects, uses and advantages of this invention are apparent from a reading of this description which proceeds with reference to the accompanying drawings forming a part thereof and wherein.

While this invention is particularly adapted for laying out an actual hole of golf that a golfer is to play, it is to be understood that the various features of this invention can be utilized singly or in any combination thereof to lay out holes of golf that are yet to be in existence for practicing battle plan techniques or for other purposes.

Figure 1:
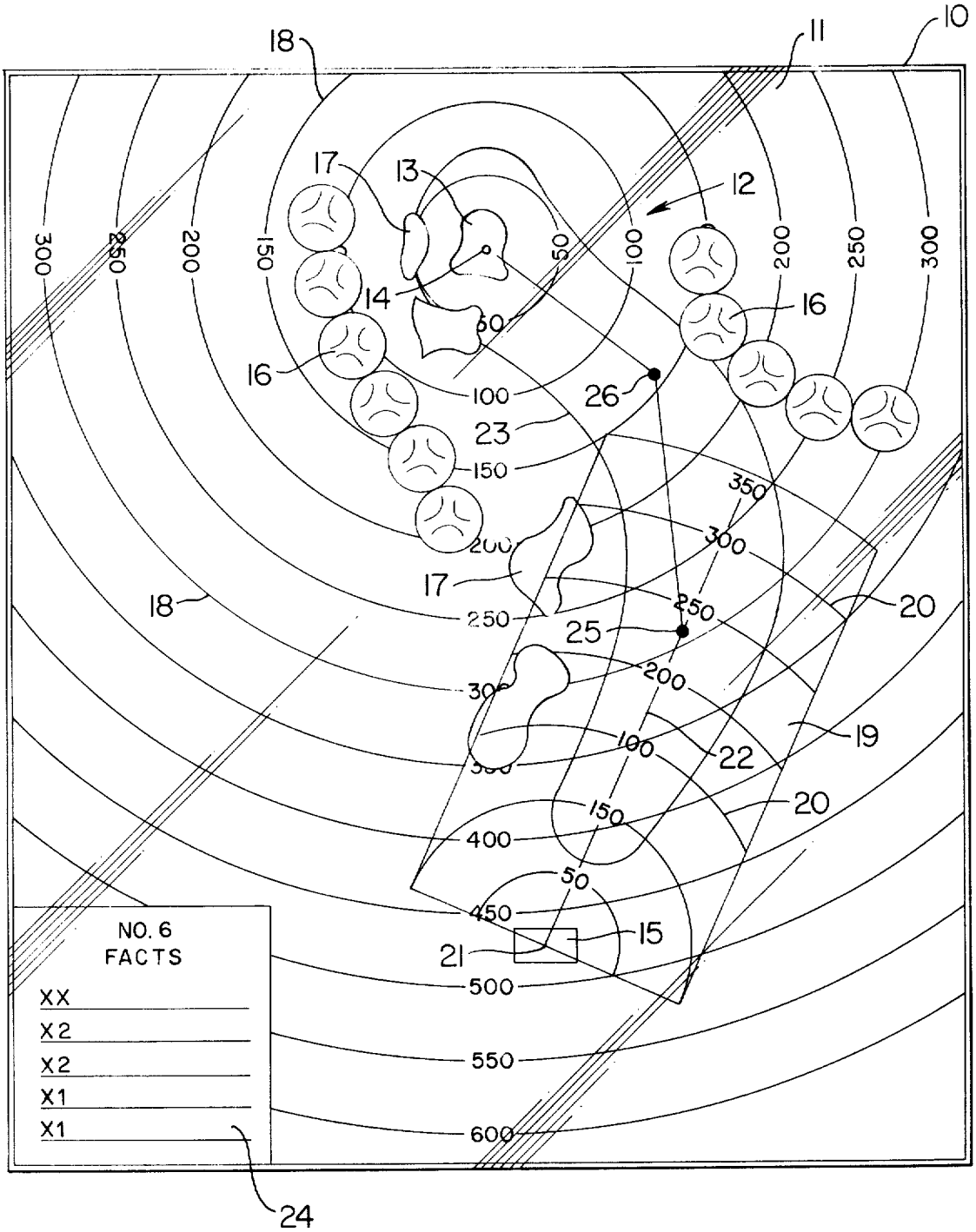
FIG. 1 is a plan view of the assembled sheets of this invention disposed in a transparent pocket means and representing a particular hole of golf that a golfer will subsequently play.

Referring now to FIG. 1, the golf hole layingout kit of this invention has been utilized to produce a unit 9 that is a completed simulation of a particular hole of golf and comprises an outer transparent covering envelope or pocket member 10 having disposed therein a first sheet means 11 on which the simulated hole of golf is provided and is generally indicated by the reference numeral 12. The hole of golf 12 comprises a simulated golf green 13 disposed on the sheet 11 and having as its center a point 14 provided on the sheet 11. A golf tee off area 15 is disposed on the sheet 11 in a preselected position from the point 14 of the sheet 11 for representing the golf tee area of the golf hole 12. A plurality of members simulating natural hazards, such as trees 16 and traps 17, are disposed on the sheet 11 in positions that most represent the actual hazards of the hole being depicted or simulated by the golf hole 12 of FIG. 1.

The sheet 11 has a plurality of preformed arcs 18 provided thereon in concentric manner and each being described from the point 14 on the sheet 11 to designate incremental distances from the point 14 and being of a number that would cover the distances for better than 90% of the holes of golf in actual existence.

A second sheet 19 of transparent material has a plurality of arcs 20 formed thereon in a concentric manner and each being described from a point 21 formed on the sheet 19 so as to represent incremental distance from the point 21.

As illustrated in FIG. 1, the sheet 19 is laid on the sheet 11 in such a manner that the point 21 of the smaller sheet 19 is disposed in a desired location on the tee area 15 and with the incremental distances 20 thereon being disposed outwardly from the tee area 15 in a desired first shot direction for that particular golfer. If desired, the sheet 19 can actually have a straight line means 22 formed thereon for representing the path of a "drive" or first shot from the tee off area 15 as illustrated.

If desired, the sheet 11 can have a free hand marking or cut-out means disposed thereon to designate an outline 23 of the fairway that is provided by the hole of golf 12 as illustrated.

In addition, a fact sheet 24 can also be disposed on the sheet 11 in an out-of-the-way manner from the hole of golf 12 and on which can be recorded pertinent facts that the golfer should review before actually playing the hole of golf so as to minimize trouble that the golfer might encounter. For example, such fact sheet could remind the golfer that because the fairway is slightly rising from tee area to green he should use a lower number club than that which he would normally be expected to be utilizing for a particular shot. Also, such fact sheet could contain the same type of information that the book, *Situation Golf*, provides for the simulated holes therein and considered as "Pertinent Facts" therein.

After the sheets 11 and 19 have been assembled together in the manner illustrated in FIG. 1, the golfer can then mark thereon in any appropriate manner the shot path that that particular golfer should follow to use his ability in trying to par or score his best for such hole. Such battle plan can be provided on its assembled sheets by various marking pencils, etc.

For example, the hole 12 illustrated in FIG. 1 is a par 5 hole and the golfer is of average ability so that a first marking 25 is provided for his desired drive of slightly more that 225 yards straight down the fairway. The golfer then locates a marking 26 where it would be most strategic for his second shot to be played in order to avoid what hazards he might encounter while still giving the golfer the best possible approach shot for his ability so as to reach the green 13 on this third shot.

Figure 2:
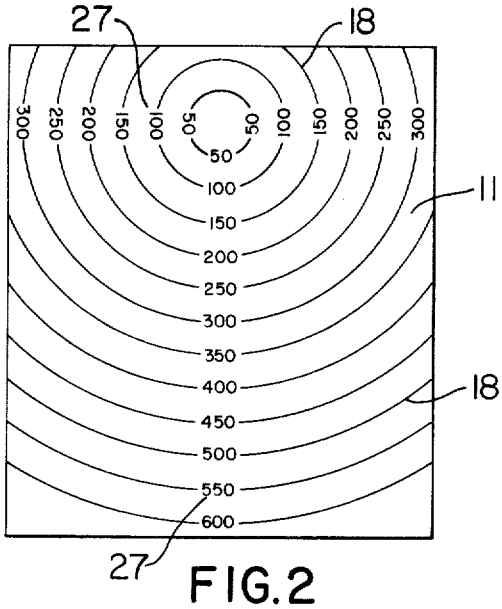
FIG. 2 is a reduced plan view of one of the sheets for forming the combination illustrated in FIG. 1.
Figure 3:
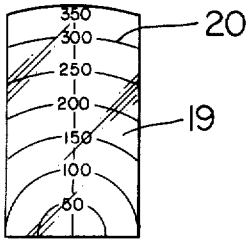
FIG. 3 is a smaller view of another sheet utilized in forming the combination of FIG. 1.

Such previously described unit 9 for simulating the hole of golf 12, or any other hole of golf can easily be formed by the golfer using the standard sheet 11 of FIG. 2 which has the incremental arcs 18 formed thereon and being appropriate labeled by incremental numbers 27 in any appropriate manner.

Figure 4:
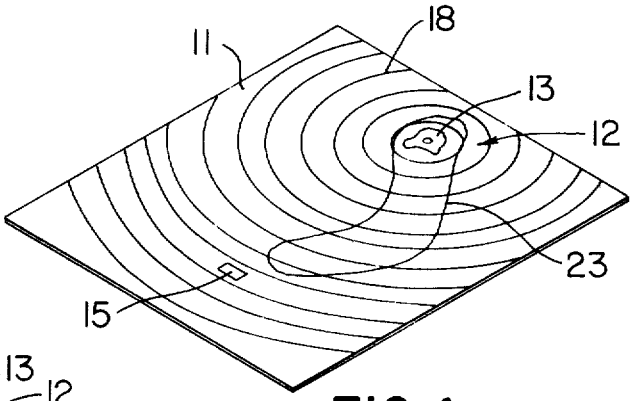
FIG. 4 is a perspective view of the sheet of FIG. 2 having a golf green and a golf tee area disposed thereon as well as an outline of the fairway of the hole of golf that is to be depicted or simulated thereon.

As illustrated in FIG. 4, such sheet 11 has the golf green 13, tee area 15 and fairway designation 23 disposed thereon in initially laying out the golf hole 12.

Figure 5:
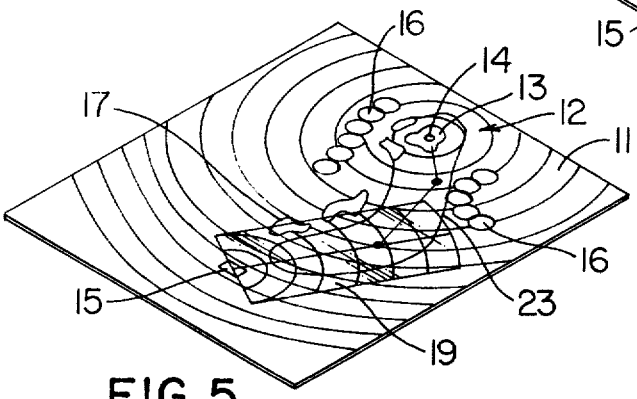
FIG. 5 is a view similar to FIG. 4 and illustrates the second sheet of FIG. 3, as well as means representing natural hazards for the particular hole of golf, being disposed on the sheet of FIG. 4. In addition, the planned shots for the hole of golf are laid out on the assembled sheets in FIG. 5.

Thereafter, the golfer places the golf hazards 16 and 17 and second sheet 19 on the first sheet 11 of FIG. 4 in the manner illustrated in FIG. 5. The battle plan of the best way to play that hole of golf is then marked thereon in the manner previously described.

Figure 6:
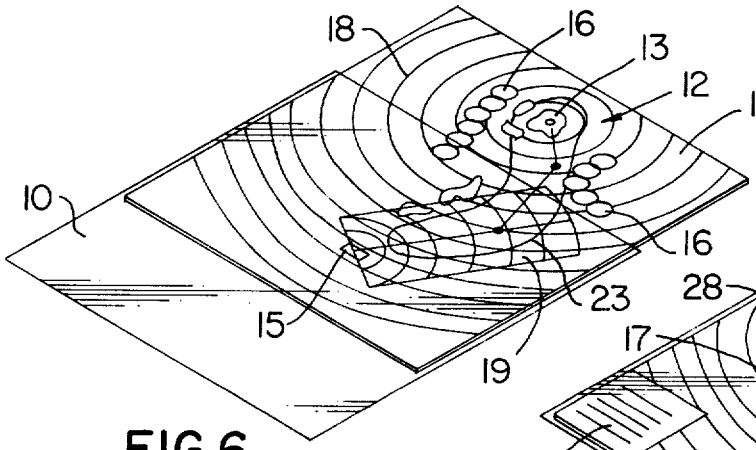
FIG. 6 is a view similar to FIG. 5 and illustrates the assembled sheets of FIG. 5 being inserted in a transparent covering member.
Figure 7:
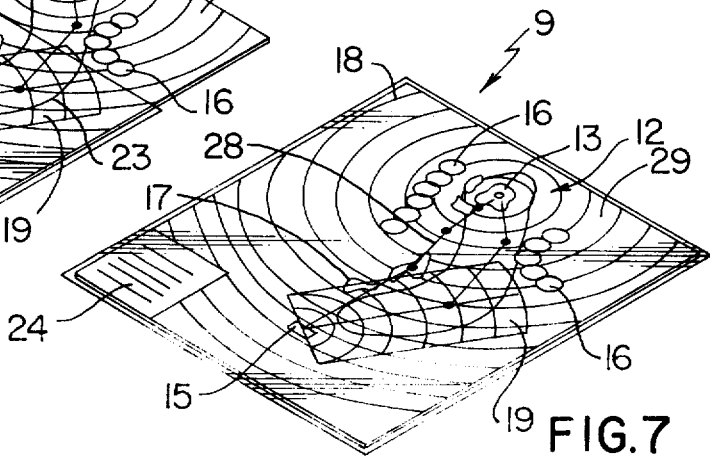
FIG. 7 is a view similar to FIG. 6 and illustrates the assembled sheets fully received within the pocket member and with the pocket member having markings disposed thereon representing an actual playing of the hole of golf simulated by the sheets.

Thereafter, the assembled sheets of FIG. 5 that depict the desired hole of golf are slipped into a transparent envelope or covering pocket member 10 as illustrated in FIG. 6 along with the fact sheet 24 to form the completed unit 9 illustrated in FIGS. 1 and 7.

However, in FIG. 7 the unit 9 is actually used by itself when playing the hole of golf depicted thereon so that the golfer has marked the particular ball's course and strokes by suitable markings 28 on the outer surface 29 of the covering 10 in the manner illustrated in FIG. 7 for later study or recording purposes.

For example, the outer covering 10 can be formed of transparent material that is readily marked by a certain type of marking member, such as a felt pen or the like, and which can be easily cleaned off for later reuse thereof.

Alternately, the user may take the unit 9 of FIG. 1 as a "master" and through the use of a Xerox machine or the like form a plurality of copy sheets therefrom for permanent marking thereon as the particular hole of golf is played so that throughout a particular year the golfer can see what improvement he has made throughout the year in scoring on a particular hole and also whether he is playing the hole in the manner that he best believes that he should be attacking such hole.

While only one hole of golf has been previously described as being formed from a kit of this invention, it is to be understood that a person could be provided in kit form or book form a plurality of sheets 11, a plurality of sheets 19, a plurality of sheets having the hazards 16 and 17, as well as other hazards, in predetermined cut out form or for the user's desired cut out configurations, and sheets for the golf greens 13 and tee areas 15 so that the same can either be cut from such sheets or punched therefrom and be disposed on the sheets 11 in a desired manner to produce 18 holes of simulated golf holes or more as desired. Of course, such kit would include 18 pocket members or just nine pocket members so that two holes could be utilized at each pocket member 10 in a back-to-back relation.

The sheets 11 could be formed with a green background and the various hazards, golf greens and tee areas could be formed with other distinct colorings either natural or in a manner to quickly call to the golfer's attention that a certain area is really to be avoided as the same has been constantly his downfall, etc. Also, such members that are to be subsequently disposed or the sheets 11 could be secured thereon in a permanent manner or in a readily removable manner so as to be rearrangeable, if desired.

Thus, it can be seen that this invention provides means wherein a golfer can lay out one or more golf holes that he normally encounters and from which he can plan his attack of the hole or holes in a manner to best suit his ability and from such information actually keep records of his golf rounds for any desired purpose.

Also, such golf hole units 9 of this invention can be utilized to record more than one players actual playing of the golf hole for later discussion purposes, such as for rehashing of a round of golf, etc.

While the form of the invention now preferred has been described as required by the patent statutes, other forms may be utilized all coming within the scope of the appended claims.

What is claimed is:

1. A method of playing strategy golf actually or vicariously comprising the steps of using a sheet member having uniformally spaced apart increments of distance thereon extending away from a readily discernible location thereon in sufficient directions from said discernible location that said sheet member can readily accommodate proportionally accurate layouts of the widely varying holes played by golfers, including holes having a dogleg to the right of the tee area and a dogleg to the left of the tee area with said increments of distance extending to said tee area, and laying out, on said sheet member and over said increments of distance thereon, the characteristics of a particular hole to be played actually or vicariously by the golfer by disposing means on said sheet member at said readily discernible location to represent the golf green of said hole, disposing means on said sheet member at the appropriate distance from said readily discernible location to represent the golf tee area of said hole, disposing means on said sheet member between said tee area representation and said green representation to represent the locations of the landmarks and hazards of said hole that could be encountered by the golfer in playing said hole, determining from said laid out sheet member or a copy thereof the first strategic shot path that the golfer could follow with his particular golf playing abilities or vicarious abilities to reach a first desired strategic location in attempting to reach the green of said hole in a minimum number of strokes for those said abilities, and playing a first golf ball shot actually or vicariously in an attempt to reach said first strategic location, whereby on reaching the area of said first played golf ball shot, said increments of distance and the relationship of said landmarks and any noted hazards yet to be encountered enable said golfer to readily predetermine any additional strategic golf ball shot paths that could be followed actually or vicariously to reach successive strategic locations from which subsequent actual or vicarious shots could be taken to reach the green of the hole being played with a minimum member of strokes for the golfer's actual or vicarious ability.

2. A method as set forth in claim 1 and including the step of recording on one of said laid out sheet member and said copy thereof the golf shots taken when playing that golf hole actually or vicariously.

3. A method as set forth in claim 1 and including the step of covering one of said laid out sheet member and said copy thereof with a transparent sheet means.

4. A method as set forth in claim 3 and including the step of recording on said covering transparent sheet means the golf shots taken when playing that golf hole actually or vicariously.

5. A method as set forth in claim 3 wherein said step of covering comprises the step of placing said one of said laid out sheet member and said copy thereof in a transparent pocket-like member.

* * * * *